US007475505B2

(12) United States Patent
Sadowski

(10) Patent No.: US 7,475,505 B2
(45) Date of Patent: Jan. 13, 2009

(54) DISPLAY DEVICE

(76) Inventor: Paul Sadowski, 2444 Irma, Warren, MI (US) 48092

( * ) Notice: Subject to any disclaimer, the term of this patent is extended or adjusted under 35 U.S.C. 154(b) by 486 days.

(21) Appl. No.: 11/248,514

(22) Filed: Oct. 12, 2005

(65) Prior Publication Data

US 2006/0101686 A1 May 18, 2006

Related U.S. Application Data

(60) Provisional application No. 60/618,431, filed on Oct. 12, 2004.

(51) Int. Cl.
*G09F 19/00* (2006.01)

(52) U.S. Cl. ..... 40/535; 40/376; 40/403

(58) Field of Classification Search ..... 40/530, 40/535, 372, 376, 398, 403, 904; 281/38, 281/DIG. 1

See application file for complete search history.

(56) References Cited

U.S. PATENT DOCUMENTS 605,148 A * 6/1898 Sylvester ..... 40/504
950,006 A * 2/1910 McCarty ..... 211/162
2,625,935 A * 1/1953 Marano ..... 206/311
3,325,934 A * 6/1967 Rhude ..... 40/530
3,374,794 A * 3/1968 Reed ..... 206/225
3,642,338 A * 2/1972 Humphrey ..... 312/184
4,183,162 A * 1/1980 Applebaum et al. ..... 40/530
5,709,409 A * 1/1998 Engel ..... 281/29

* cited by examiner

*Primary Examiner*—Gary C Hoge
(74) *Attorney, Agent, or Firm*—The Weintraub Group, PLC

(57) ABSTRACT

A notebook-like display device includes a mounting panel, or pair of conjoined panels, mountable to a wall, a pair of guide brackets, and a set of display leaves, the leaves being mounted to the support brackets and manipulated by a demonstrator and like personnel with one hand, in a flipping manner, freeing the user's other hand to perform tasks related to use of the display device. The panels and leaves are generally planar, rectangular, and substantially rigid, such as of a high density polymer, composite, or fiberboard. The leaves are constrained by retention elements, received in the support brackets, for movement between first and second positions, respectively, wherein the leaf is revered but in superposed generally parallel relation with one and the other side of the panel and other of the leaves. Magnets or other holding devices operate between the leaves and panel(s) to retain the leaves in each position.

9 Claims, 2 Drawing Sheets

DISPLAY DEVICE

CROSS-REFERENCE TO RELATED APPLICATIONS

This application claims the benefit of United States Provisional Patent Application Ser. No. 60/618,431, filed Oct. 12, 2004, the entire disclosure of which is hereby incorporated by reference.

BACKGROUND OF THE INVENTION

1. Field of the Invention

The present invention pertains to display devices, and more particularly, to a wall-mounted notebook-like display device with movable display leaves which can be manipulated by a demonstrator and like personnel with one hand, freeing the user's other hand to perform tasks related to use of the display device.

2. Description of Related Art

Display devices are known and take many shapes and forms. In some applications, the display device is used to display photographs, new products, charts, and like information.

Oftentimes, individual sheets are secured along their top edges, and the sheets pulled upwardly and over the top, wherein new or previous sheets and data may be displayed. Such is useful but does not allow for rapid display of information, in that sheets previously folded up and over present a problem for the user. Manipulating the sheets is difficult and oftentimes requires both hands.

The ability to move forwardly or rearwardly, and having a hand free would be desirable.

Further, the display device may not enable the mounting, and rapid unmounting, of a large number of items, such as photographs, to be displayed.

Desirably, a device for mounting, displaying, and showing a large number of photographs would be desirable.

SUMMARY OF THE INVENTION

According to this invention, a display device comprises a planar generally rectangular rigid panel having a front surface, the rear surface of the panel being adapted to be mounted to a support wall, a plurality of planar generally rigid display leaves, means for mounting the leaves to the panel, said means for mounting enabling the display leaves to be moved from first and second positions and generally parallel relation with one another and the front surface, the movement being in a flipping motion causing and means for retaining the leaves in superposed generally parallel relation with one another and the front surface inm each such position. The movement is in a "flipping motion" whereby the movement causes the surfaces of the leaf to be moved from exposed and hidden from view.

According to this embodiment, the mounting panel may comprise a pair of like shaped panels, the panels being generally rectangular, conjoined along a common edge, and the panel assembly mounted to the wall. Further, so mounted, the mounting panel(s) may be oriented such that the long dimension of the mounting panel extends horizontally, whereby the leaves are flipped laterally, about a vertical axis, and from one to the other side of the mounting panel front surface. Equally, the mounting panel(s) may be oriented such that the long dimension of the mounting panel extends vertically, whereby the leaves are flipped laterally up and down, about a horizontal axis, and from one to the other side of the mounting panel front surface.

The means for mounting the leaves to the panel comprises a pair of spaced apart support brackets, each support bracket having a U-shaped guide track therein, and retention rods associated with an edge of the leaf, the retention rods being associated with like edges of the leaves. The retention rod is axially elongated, has opposite end portions received in the guide tracks of the support brackets, and a retention cap at each end whereby to retain the retention rod for sliding movement relative to the support brackets.

According to an aspect of this embodiment, the support brackets are affixed to the mounting panel(s) by studs in such a manner as to be perpendicular to and project upwardly and away from the front surface of the mounting panel(s). The U-shaped guide tracks are oriented such that each has opposite ends proximate to the front surface of the panels(s) and a medial portion spaced from the front surface.

Further and according to this embodiment, the means for retaining includes at least one magnet at each lateral side of the mounting panel and a corresponding magnet at the outer lateral edge of each said leaf, the outer lateral edge being distal to the retention rod. The leaf is flipped relative to the support brackets, whereupon the magnet in the leaf is disengaged from magnetic attraction with the magnet in one side of the mounting panel and into registration and magnetic attraction with the magnet in the other side of the mounting panel. The leaf, so moved, is substantially parallel to the front surface of the mounting panel and whatever leaves are positioned one or the other side of the mounting panel.

Where leaves may be positioned on one or the other side of the mounting panel, the flipping movement causes the magnet on the leaf being flipped to be moved from attraction with the magnet in a leaf on one side of the mounting panel and into registration and attraction with the magnet in a leaf on the other side of the mounting panel.

Depending on the application, the panel(s) and leaves are of a rigid material. In one preferred aspect, the leaves and mounting panel(s) are of a composite material sold under the trade name Masonite®. Alternatively and according to another preferred aspect, the leaves and the mounting panel (s) are molded of a high-density polymeric material. In some applications, the panel(s) and leaves may be comprised of one and the other of the composite Masonite® and molded of high density polymeric material.

Depending on the material selected, the method of retaining the leaves to the mounting panel(s) may be varied. For example, with the composite material, the retention rod may be disposed within a socket provided along the inward edge of the leaf. In the instance wherein the leaves or mounting panel (s) are of polymeric material, the retention rod may be molded into the material along an edge of the leaf and the mounting studs and magnets integrally molded into the polymeric material.

The present invention will be more clearly understood with reference to the accompanying drawings and to the following Detailed Description, in which like reference numerals refer to like parts and where:

DETAILED DESCRIPTION OF THE PREFERED EMBODIMENT

Figure 1:
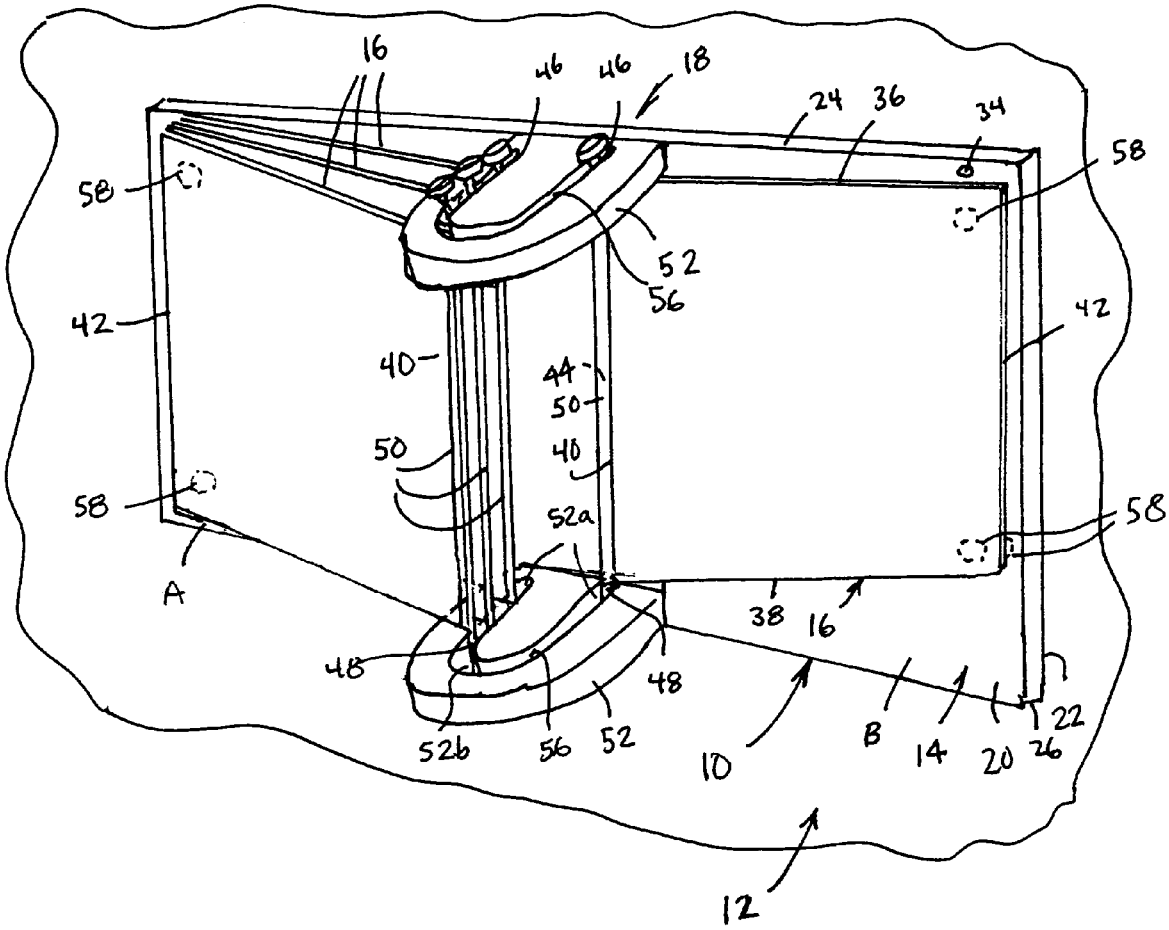
FIG. 1 is a perspective view of a wall mounted picture frame or display device according to the present invention.

Referring first to FIG. 1, a notebook-like display device 10 of the present invention is shown in use. The display device 10 is mounted to a wall 12 and is adapted to be manipulated by a demonstrator and like personnel with one hand, freeing the user's other hand to perform tasks related to use of the display.

The display device 10 comprises a rigid, generally flat (or planar) rectangular shaped mounting panel 14, a plurality of rigid, generally flat (or planar) leaves 16, and a combined mounting and retaining mechanism 18 for mounting the leaves for flipped movement between first and second positions "A" and "B" on the panel 14. The mounting panel 14 includes opposed generally planar front and rear surfaces 20 and 22 and is mounted to the wall 12 in a manner that the rear surface 22 is juxtaposed against the wall and the front surface 20 faces outwardly. The flipping movement of the leaf reverses the relationship of the leaf relative to the front surface 20 of the panel and causes the surface of the leaf initially facing outwardly and away from one half of the front surface 20 to be facing inwardly and towards the other half of the front surface 20.

Figure 2:
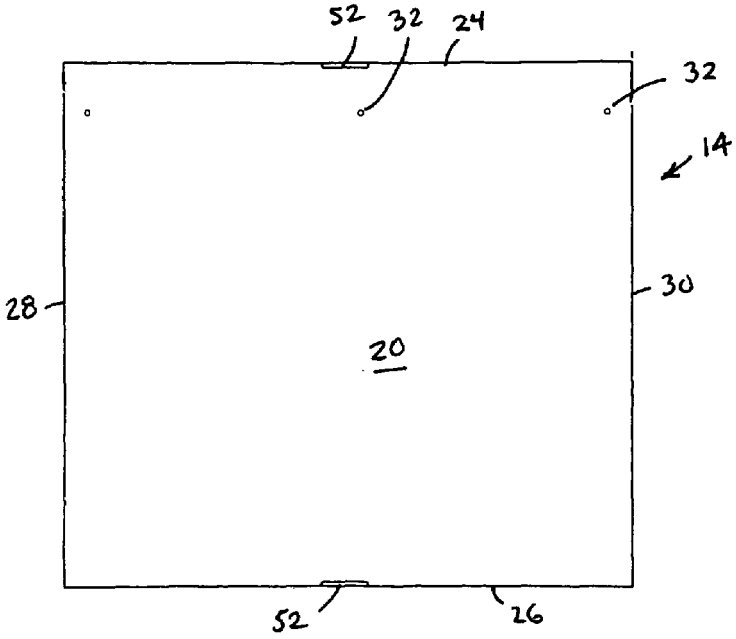
FIG. 2 is a plan view of a panel of the display device shown in FIG. 1.
Figure 3:
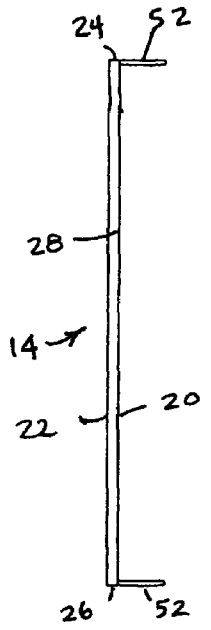
FIG. 3 is a side view of the panel shown in FIG. 2.
Figure 4:
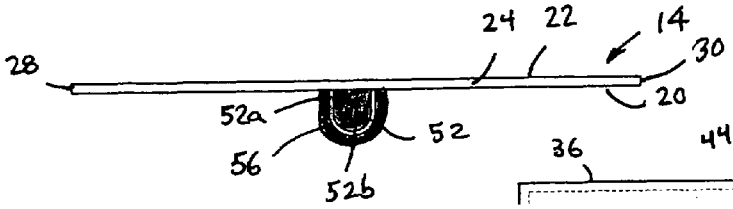
FIG. 4 is a top view of the panel shown in FIG. 2.

Further, referring also to FIGS. 2-4, the mounting panel 14 includes upper and lower edges 24 and 26, opposite lateral edges 28 and 30, and countersunk apertures 32. The mounting panel 14 is mounted to the wall 12 by fasteners 34 being received in the apertures 32 and attached to the wall therebehind. So mounted, the upper and lower edges 24 and 26, which define the long dimension of the panel, are disposed horizontally, and the lateral edges 28 and 30, which define the short dimension of the panel 14, are disposed vertically.

As shown, the mounting panel 14 is one-piece, generally rectangular, the long dimension is arranged horizontally, and the leaves 16 are adapted to be flipped from left to right about an axis disposed vertically. For some applications, and for shipping considerations, the mounting panel 14 may be in two pieces and the two pieces, or panels, conjoined along a common edge.

Further, while the mounting panel 14 is shown oriented horizontally, the long dimension of the rectangular shaped panel may be arranged to extend vertically, with the leaves 16 being adapted to be flipped vertically up and down about an axis disposed horizontally.

Figure 5:
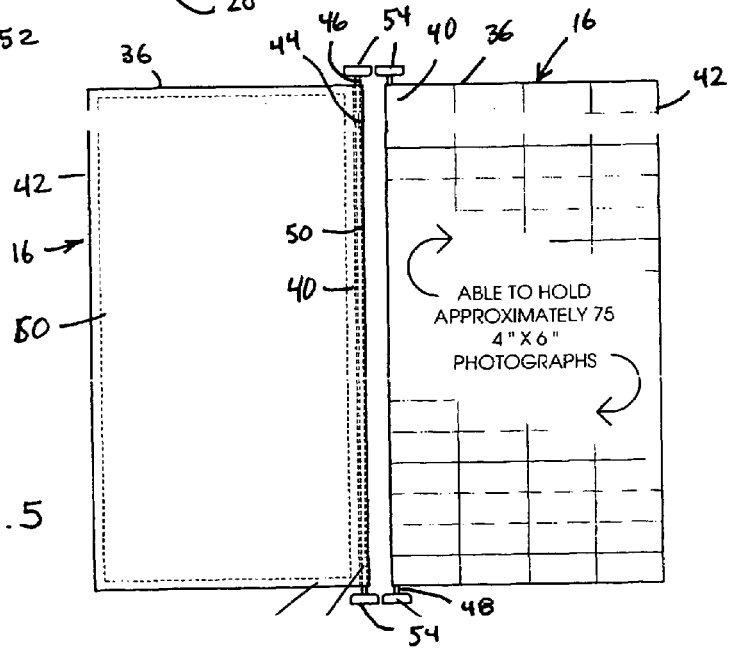
FIG. 5 is a plan view of two leaves of the display device, in side-by-side relation.

Referring to FIGS. 1 and 5, the leaves 16 are generally rectangular and each includes upper and lower edges 36 and 38, and inner and outer edges 40 and 42. The leaf 16 is generally flat, planar, and includes first and second display surfaces or faces. When mounted, the surfaces of the leaves are generally parallel to the front surface of the mounting panel or the other leaves. When flipped, one and the other surface of the leaf is moved from a position where the surface faces outwardly (i.e., is exposed) or faces inwardly (i.e., is hidden from view).

Preferably, the panel 14 and the leaves 16 are integrally molded from a high-density polymer. The thickness and shape of the leaf is configured such that each leaf is generally rigid. As will be described herein below, the polymeric material is such as to enable retention rods, magnets, and mounting studs to be integrally molded therewith and be accurately positioned.

In some applications, the mounting panel(s) 14 and leaves 16 are of a fiberboard, particle board, or like hard and rigid sheet of material used in paneling, or partitions, and rigid plastic such as an acrylic, polycarbonate, etc. One suitable material is sold under the name Masonite®.

Likewise, the mounting panel(s) may comprise glass or metal sheets.

The combined mounting and retaining mechanism 18 comprises an axially elongated retention rod 44, one retention rod for each leaf 16 and each rod having opposite end portions 46 and 48, a retention sleeve or socket 50 for mounting a retention rod to the inner edge 40 of the leaf, and a pair of U-shaped brackets 52 for mounting and retaining the leaves 16 to the panel 14. The retention rod 44 is axially elongated and the upper and lower end portions 46 and 48 thereof terminate in an end cap 54, shown as having a T-shape.

The mounting or support brackets 52 are spaced apart, attached to the upper and lower edges 24 and 26 of the mounting panel 14, and project perpendicularly upwardly and outwardly from the front surface 20 of the panel. In the embodiment shown, threaded fasteners (not shown) are used to attach each support bracket 52 to the panel. The fasteners enter the panel from the rear surface 22 and extend into the support brackets 52. In some applications, depending on the material selected, the support brackets may be affixed to the panel by mounting studs. Desirably, in the situation wherein the panel is of high-density polymer, the studs may be embedded into place within the polymer.

In the situation wherein the mounting panel 14 comprises a single panel, or a pair of conjoined panels, and the mounting panel(s) and leaves are of polymeric material, each of the leaves are connected to the panel(s) by a retention rod. The retention rod is integrally molded into and extends along one edge of the leaf into which molded.

Each support bracket 52 includes a U-shaped slot or guide track 56, and each guide track has opposite ends 52*a* thereof proximate to the surface 20 and a medial portion 52*b* spaced outwardly from a centerline extending vertically between the upper and lower edges of the panel 14. The guide tracks 56 of the upper and lower brackets 52, respectively, are aligned with one another and receive the upper and lower end portions 46 and 48 of the retention rods 44. The end caps 54 are disposed above and below the upper and lower brackets 52 and act to retain and captivate each assembly of a leaf 16 and retention rod 44 within the guide tracks 56 and constrain the leaf 16 for sliding movement within the guide tracks 56.

The end portions 46 and 48 of the retention rod 44 are adapted to slide (or glide) relative to the slots or guide tracks 56, and enable the leaves 16 to move from the first position "A", juxtaposed in generally parallel relation with one half of the panel upper surface 20, and to the second position "B", juxtaposed in generally parallel relation with the other half of the panel upper surface 20.

According to an important aspect of this invention, the mounting panel(s) 14 and leaves 16 are provided with complementary magnetic elements to captivate or otherwise retain the leaves in the first and second positions. According to a preferred embodiment, a cylindrical permanent magnet 58 is provided in the upper and lower outer corners of each leaf 16, and a corresponding permanent magnet 58 is provided in the upper and lower outer corners of the mounting panel 14. As noted, if the mounting panel and leaves are molded of polymeric material, the magnets may be integrally molded within the body of the polymer.

In one position, all of the leaves 16 may be juxtaposed with one or the other side of the front surface 20 of the panel 14. In another position, some of the leaves may be juxtaposed with one side of the panel and other of the leaves may be juxtaposed with the other side of the panel 14. In either arrangement, the magnets on the leaves 16 are registered with a corresponding pair of the magnets 58 on the panel 14 or on a leaf therebelow and upon which flipped, the magnets attracting each other and operating to prevent unwanted swinging movement of a leaf, or leaves, from one position to another, or away from retained relation with the panel 14.

Alternatively, a magnetic strip 60 (see FIG. 5) may extend around the perimeter of each leaf and the lateral ends of the panel.

It should be stated that, although not shown, alternative means for retaining the leaves in position may be used in lieu of the magnet, such as a clasp, retainer clip, or similar design. Further, interfitting protuberances and recesses operating between the leaves and panel(s) and which frictionally releasably engage with one another are contemplated herein.

In a preferred embodiment, the display device 10 is characterized as a wall mounted picture frame, with the leafs 16 being adapted to hold multiple sized pictures on numerous of the leafs 16. The display device 10 provides a picture display that doubles as a wall covering.

In some applications, a binder (not shown) may be used to mount picture frames to the wall mount display device 10.

In one embodiment, the panel 14 is about 5 feet 4 inches wide, 5 feet high, and the leaves 16 are able to hold approximately 75 photographs that measure 4 inch by 4 inch.

In another embodiment, the panel 14 is 31 inches wide by 15½ inches high and can hold up to ten (10) 4×6 inch photos.

The user may with ease move the leaves, as desired, to display photographs and other materials mounted on the leaves. In the situation wherein advertising or other material is to be presented to a business meeting, with one hand the displayer may move the leaves, leaving the other hand free for other use, such as using a pointer.

The invention having been thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A display device, comprising a planar generally rectangular rigid mounting panel having a front surface and opposite edges that define a long dimension of the panel, the panel being adapted to be mounted to a support wall, a plurality of planar generally rigid display leaves, each leaf having a first and a second surface, upper and lower edges, and a rear edge extending between said upper and lower edges, mounting means for mounting the display leaves to the panel, said mounting means being associated with the rear edges of said display leaves and enabling each said leaf to be moved from a first position wherein the first and second surfaces thereof are facing towards and away from the front surface and a second position wherein the first and second surfaces thereof are facing away from and towards the front surface, the leaves in each said position being in generally parallel relation with one another and the front surface of the panel, and at least one magnetic strip around substantially the entire perimeter of each said leaf and the lateral end portions of said mounting panel, the magnetic strips of the leaves and mounting panel being brought into magnetic retaining attraction with one another when the leaves are flipped between the first and second positions.

2. The display device of claim 1, wherein each said leaf includes a retention rod having opposite end portions, the end portions protruding above the upper and lower edges of the leaf, said mounting means comprises a pair of spaced apart support brackets, each said support bracket being secured to said panel and having a U-shaped guide track therewithin for receiving a respective end portion of each said retention rod, and further comprising securing means for securing the retention rods to the rear edges of the leaves, and a retention cap at each end portion of said retention rod, the retention caps captivating the retention rod in the guide tracks of the support brackets and for sliding movement between the ends of the guide tracks thereof.

3. The display device of claim 2, wherein the U-shaped guide tracks have opposite ends proximate to the front surface and a medial portion spaced from the front surface, the guide tracks being disposed along a common axis located between and generally parallel to the opposite edges of said mounting panel.

4. The display device of claim 1, wherein said retaining means includes at least one magnet at each opposite lateral edge portion of the mounting panel and at least one corresponding magnet at an outer lateral end portion of each said leaf, the magnet of a first of said leaves being moved from and into registration with the magnet of one and the other lateral edge portion of the mounting panel or the magnet at the outer lateral end of a second of said leaves when the first leaf is moved from the first to second position.

5. The display device of claim 4, wherein the mounting panel and leaves are of a rigid material and of a thickness substantially resistant to flexure.

6. The display device of claim 5, characterized that the leaves are molded of a rigid high density polymeric material

7. The display device of claim 5, characterized in that the leaves are comprised of a rigid substantially inflexible material selected from the group consisting of particle board, a composite material, and a rigid plastic material.

8. The display device of claim 7, wherein the particle board material is commercially available and sold under the trade name Masonite®.

9. The display device of claim 1, wherein said mounting means comprises a pair of spaced apart support brackets, each said support bracket being secured to said panel and having a U-shaped guide track therewithin for receiving a respective end portion of each said retention rod, said guide tracks being aligned with the axial line formed by said first and second panels.

* * * * *